US009523959B2

(12) United States Patent
Kawai

(10) Patent No.: US 9,523,959 B2
(45) Date of Patent: Dec. 20, 2016

(54) IMAGE FORMING APPARATUS WITH CONTROL UNIT CONFIGURED TO REDUCE THE AIR BLOWN BY A BLOWER UNIT REACHING AN EXPOSURE UNIT

(71) Applicant: CANON FINETECH INC., Misato-shi, Saitama (JP)

(72) Inventor: Shintaro Kawai, Tsukubamirai (JP)

(73) Assignee: Canon Finetech Inc., Misato-shi (JP)

( * ) Notice: Subject to any disclaimer, the term of this patent is extended or adjusted under 35 U.S.C. 154(b) by 0 days.

(21) Appl. No.: 14/863,951

(22) Filed: Sep. 24, 2015

(65) Prior Publication Data

US 2016/0091860 A1 Mar. 31, 2016

(30) Foreign Application Priority Data

Sep. 30, 2014 (JP) ..... 2014-201075
Jul. 21, 2015 (JP) ..... 2015-144069

(51) Int. Cl.
*G03G 21/20* (2006.01)

(52) U.S. Cl.
CPC ..... *G03G 21/206* (2013.01); *G03G 21/203* (2013.01); *G03G 2221/1645* (2013.01)

(58) Field of Classification Search
CPC ..... G03G 21/206; G03G 21/203; G03G 2221/1645
See application file for complete search history.

(56) References Cited

U.S. PATENT DOCUMENTS 7,623,822 B2 11/2009 Matsuno
2005/0280682 A1* 12/2005 Kato ..... B41J 11/002 347/102
2008/0025751 A1* 1/2008 Andoh ..... G03G 15/5004 399/94
2013/0183059 A1* 7/2013 Yokokawa ..... G03G 21/206 399/92

FOREIGN PATENT DOCUMENTS

JP 2012032436 A * 2/2012
JP 2014-126763 A 7/2014
KR 20070097993 A * 10/2007

* cited by examiner

*Primary Examiner* — David Gray
*Assistant Examiner* — Laura Roth
(74) *Attorney, Agent, or Firm* — Fitzpatrick, Cella, Harper & Scinto

(57) ABSTRACT

An image forming apparatus includes an exposure unit, a developing unit, a transferer, a fixer, a determiner, a blower, and a controller. The exposure unit exposes an image bearing member to light according to image data to form an electrostatic latent image. The developing unit is configured to develop the electrostatic latent image into a toner image. The transferer transfers the toner image onto a recording medium. The fixer heat fixes the toner image to the recording medium. The determiner determines a state of at least one of a temperature and a humidity inside the image forming apparatus. The blower generates airflow inside the image forming apparatus. The controller reduces the airflow volume of the blower based on a determination result of the determiner as the degree of the occurrence of dew condensation increases.

6 Claims, 11 Drawing Sheets

IMAGE FORMING APPARATUS WITH CONTROL UNIT CONFIGURED TO REDUCE THE AIR BLOWN BY A BLOWER UNIT REACHING AN EXPOSURE UNIT

BACKGROUND OF THE INVENTION

1. Field of the Invention

The present invention relates to an image forming apparatus including a blower unit.

2. Description of the Related Art

Hitherto, as image forming apparatus of the electrophotographic type, there are known a copying machine, a printer, and a facsimile. In the image forming apparatus, a sheet on which a developer image is formed with a developer such as toner is nipped and conveyed by a fixing roller pair including a heating roller and a pressurizing roller of a fixing device, thereby heating and pressurizing the sheet to fix the developer image to the sheet.

In this image forming apparatus, when a sheet narrower than the maximum width of the fixing roller pair of the fixing device is nipped and conveyed, in a region of the fixing roller pair in which the sheet does not pass, heat is not absorbed by the sheet, and the temperature in the region becomes higher than the temperature in a region in which the sheet passes, resulting in a non-uniform temperature distribution. To address this problem, in U.S. Pat. No. 7,623,822, in order to attain a uniform temperature distribution of the fixing roller pair, a fan configured to cool the fixing roller pair is controlled, depending on the width of the sheet.

Moreover, when sheets on which images are formed are discharged and stacked while the sheets are hot, the stacked sheets may be stuck on one another by fused developer. When the sheets stuck on one another are separated, images formed on the sheets and the sheets may be damaged. To address this problem, in Japanese Patent Application Laid-Open No. 2014-126763, air is blown from a fan to a sheet that has been heated and pressurized by a fixing device, thereby cooling the sheet.

However, when moisture contained in the sheet is vaporized when the sheet is heated during the fixing, air around the fixing device is humidified. If the humid air is moved by the airflow of the fan to the neighborhood of a laser scanner serving as an exposure device in the image forming apparatus, there is a problem that dew condensation occurs on the laser scanner, depending on an environment around the image forming apparatus.

When the dew condensation occurs particularly on a laser emission portion of the laser scanner, the laser scanner may not output the light intensity required for forming an electrostatic latent image on a photosensitive drum serving as an image bearing member, and a failure may occur during the image formation.

SUMMARY OF THE INVENTION

According to one embodiment of the present invention, there is provided an image forming apparatus, comprising:

an exposure unit configured to expose an image bearing member to light according to image data to form an electrostatic latent image;

a developing unit configured to develop the electrostatic latent image formed on the image bearing member by the exposure unit into a toner image;

a transfer unit configured to transfer the toner image developed by the developing unit onto a recording medium;

a fixing unit configured to fix the toner image, which is transferred onto the recording medium by the transfer unit, to the recording medium by heat;

a determination unit configured to determine a state of at least one of the temperature and the humidity in the inside of the image forming apparatus;

a blower unit configured to generate an airflow in the inside of the image forming apparatus; and a control unit configured to reduce the airflow volume of the blower unit based on a determination result of the determination unit as the degree of the occurrence of dew condensation increases.

Further features of the present invention will become apparent from the following description of exemplary embodiments with reference to the attached drawings.

DESCRIPTION OF THE EMBODIMENTS

Now, a description will be provided of embodiments of the present invention with reference to the accompanying drawings.

First Embodiment

Figure 1:
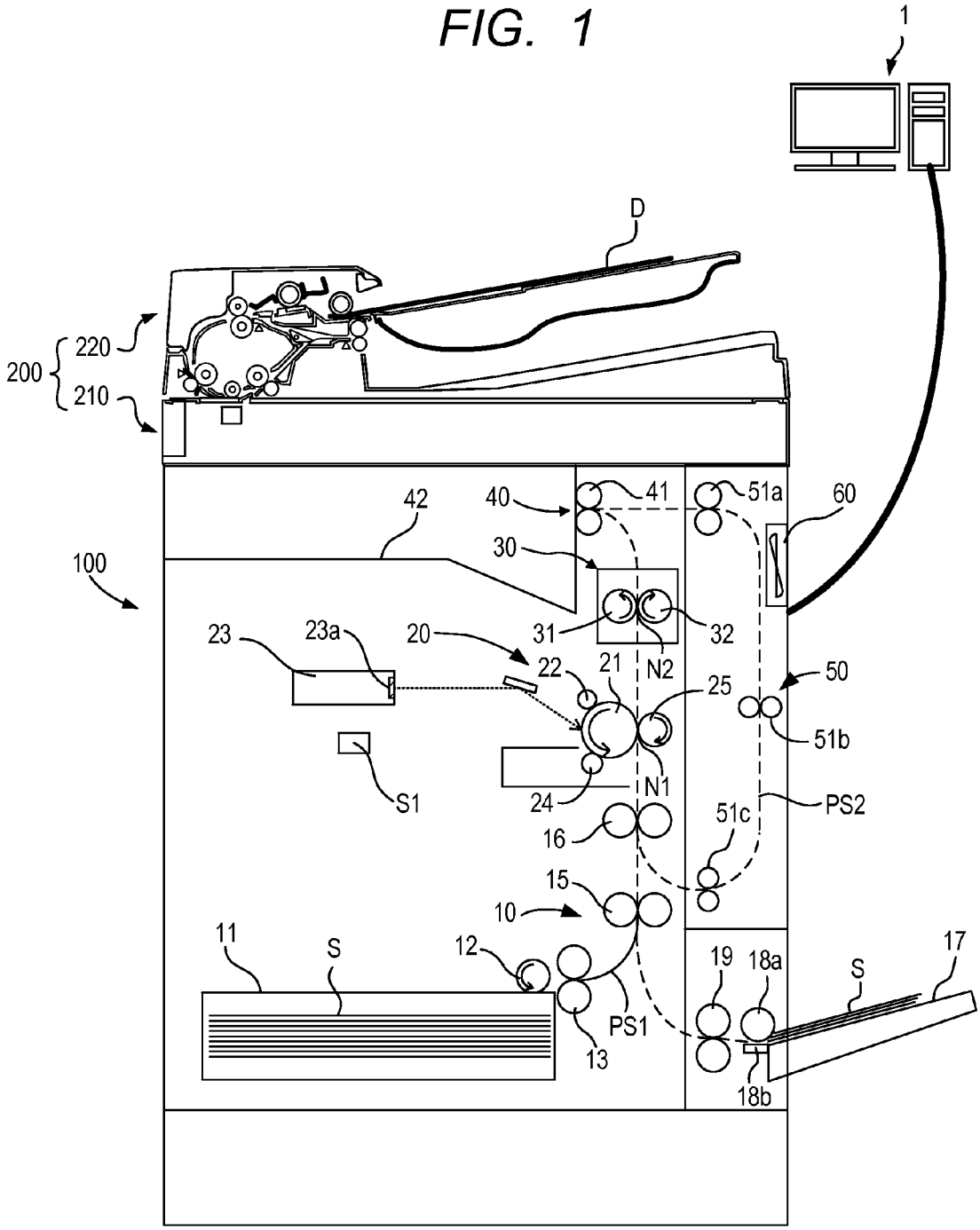
FIG. 1 is a schematic configuration diagram of an image forming apparatus according to the present invention.

FIG. 1 is a schematic cross sectional view of an image forming apparatus according to an embodiment of the present invention, and includes an image reading apparatus 200 and an image forming apparatus 100.

In FIG. 1, the image reading apparatus 200 includes an image reading portion 210 configured to read an image of an original D, and an original feeding portion 220 configured to feed an original D to the image reading portion 210.

In the image forming apparatus 100, in order from the bottom to the top, a sheet feeding portion 10, an image forming portion 20, a fixing portion 30, and a sheet discharge portion 40 are provided. Moreover, on a right side of the image forming portion 20 and the fixing portion 30, a sheet refeeding portion 50 is provided.

The sheet feeding portion 10 feeds a sheet S stacked on a feed cassette 11 or a manual feed tray 17 to the image forming portion 20. The sheet S stacked on the feed cassette 11 is fed to a separation roller pair 13 by the rotation of a pickup roller 12. When sheets S are multi-fed, a single sheet is separated from the sheets S by the separation roller pair 13 including a forward rotation roller and a backward rotation roller, and is fed to a feed path PS1 represented by the solid line.

Then, the sheet S is conveyed by a feed roller pair 15 to a registration roller pair 16. On this occasion, a skew feeding of the sheet S is corrected by aligning a leading edge of the sheet S to a nip of registration roller pair 16 whose rotation is stopped. When the sheet S is fed from the multi-sheet feed tray 17, one sheet is separated by a supply roller 18*a* and a separation pad 18*b*. Then, the sheet S is supplied by a supply roller pair 19 to the feed roller pair 15, and is conveyed to the registration roller pair 16, resulting in the correction of the skew feeding of the sheet S.

After the correction of the skew feeding, the sheet is conveyed to the image forming portion 20 by the registration roller pair 16, which starts to rotate at a predetermined timing.

In the image forming portion 20, a surface of a photosensitive drum 21 is uniformly charged by a charging roller 22. When a laser unit 23 irradiates the photosensitive drum 21 with laser light according to image information, electric charge charged by the charging roller 22 is removed from a portion of the photosensitive drum 21 irradiated with the laser light, and an electrostatic latent image according to the image information is formed. A developer is applied to the electrostatic latent image by a developing roller 24 of a developing apparatus (developing unit), and the electrostatic latent image is visualized as a developer image.

The developer image is conveyed to a transfer nip portion N1 by a rotation of the photosensitive drum 21. The sheet S is conveyed to the transfer nip portion N1 from the registration roller pair 16 synchronously with this timing. The conveyed sheet S is nipped and conveyed by the photosensitive drum 21 and a transfer roller (transfer unit) 25 at the transfer nip portion N1. On this occasion, the developer image formed on the photosensitive drum 21 is transferred onto the sheet S by a bias voltage applied by the transfer roller 25. Note that, the laser light from the laser unit 23 is controlled according to image data transmitted from the image reading apparatus 200 or a host PC 1.

Then, the sheet S on which the developer image is formed is conveyed to the fixing portion (fixing unit) 30. The fixing portion 30 is constructed by a heat source (not shown) such as a halogen lamp, a fixing roller 31, and a pressurizing roller 32. The fixing roller 31 is made of a material such as aluminum, and is heated to a predetermined temperature by the heat source. The pressurizing roller 32 is disposed so as to come into contact with the fixing roller 31 and apply a predetermined pressure to the fixing roller 31 to form a fixing nip portion N2.

The sheet S on which the developer image is formed is fed to the fixing nip portion N2, and is nipped and conveyed by the fixing roller 31 and the pressurizing roller 32. On this occasion, the developer image is fixed to the sheet S by heat and pressure. Instead of the heating roller method of heating by the fixing roller 31, the fixing portion 30 may use an on-demand fixing method in which the pressurizing roller 32 presses a heat source such as a ceramic heater 33 (FIG. 3) through an endless film to form the fixing nip portion N2 by which the sheet S is heated and pressurized while nipped and conveyed.

Then, the sheet S to which the developer image is fixed is conveyed to a sheet discharge portion 40, and is discharged by a discharge roller pair 41 to a discharge tray 42.

In the case where an image is formed on each of both surfaces of a sheet S, before a trailing edge of the sheet S, on a first surface of which an image is formed, being conveyed by the discharge roller pair 41 passes through the discharge roller pair 41, the discharge roller pair 41 is once stopped and is reversely rotated to reverse the front surface and the back surface of the sheet S and convey the sheet S to the sheet refeeding portion 50.

The sheet S, which has been conveyed to the sheet refeeding portion 50, is conveyed by refeeding roller pairs 51*a* and 51*b* on a refeeding path PS2 represented by the broken line, and is conveyed by a refeeding roller pair 51*c* to the registration roller pair 16. Then, the skew feeding is corrected by the registration roller pair 16, and then the back surface is conveyed to the transfer nip portion N1, and a developer image is thus formed on a second surface of the sheet S. Then, as in the case where the image is formed on the front surface, the developer image is fixed to the sheet S when the sheet S is conveyed through the fixing nip portion N2. The sheet S, on both surfaces of which the images have been formed, is discharged by the discharge roller pair 41 to the discharge tray 42.

Moreover, an environmental sensor S1 is disposed inside the image forming apparatus 100, and can detect a temperature and a humidity inside the image forming apparatus as electrical signals. As a detection unit for the temperature, a thermistor is generally known. As a detection unit for the humidity, a capacitive sensor is generally known. According to the embodiment, a complex sensor with a combination thereof is provided.

Figure 2:
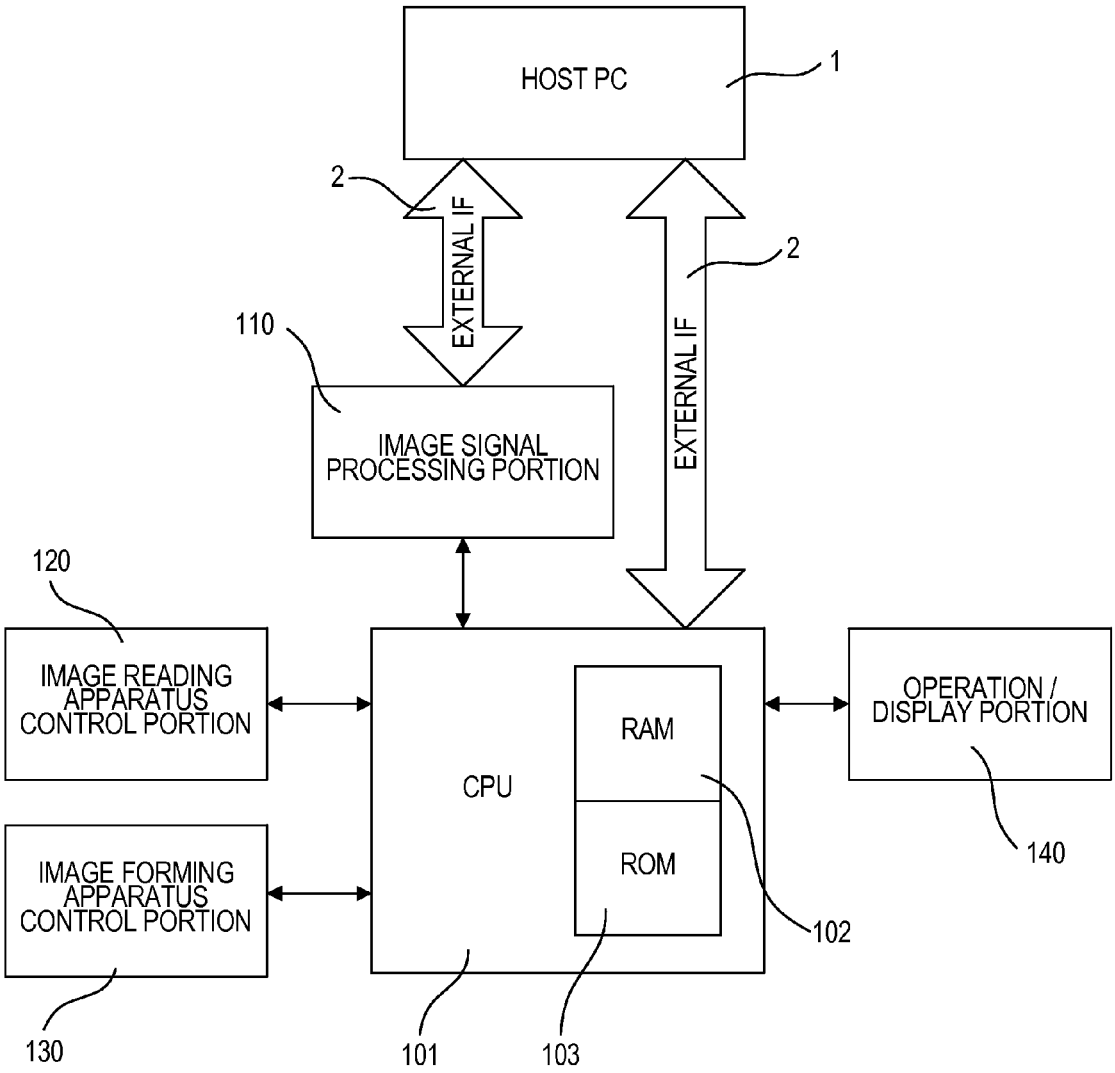
FIG. 2 is a control block diagram of the image forming apparatus.

FIG. 2 is a control block diagram of the image forming system of FIG. 1. In FIG. 2, a CPU 101 serves as a control unit. The CPU 101 includes a RAM 102, used as a storage for input data and a work storage region, and a ROM 103 configured to store programs such as a control sequence. The CPU 101 is connected to the host PC 1 through an external interface 2, and carries out the reception of image data and transmission of an apparatus status.

The CPU 101 is connected to an image reading apparatus control portion 120 configured to control the operation of reading the original and the operation of conveying the original by the image reading apparatus 200, an image signal processing portion 110 configured to process an image signal from the image reading apparatus control portion 120 or the host PC 1, an image forming apparatus control portion 130 configured to form an image on the sheet according to the image signal transmitted from the image signal processing portion 110, and an operation/display portion 140 configured to carry out setting of the apparatus as well as displaying a message to a user.

Figure 3:
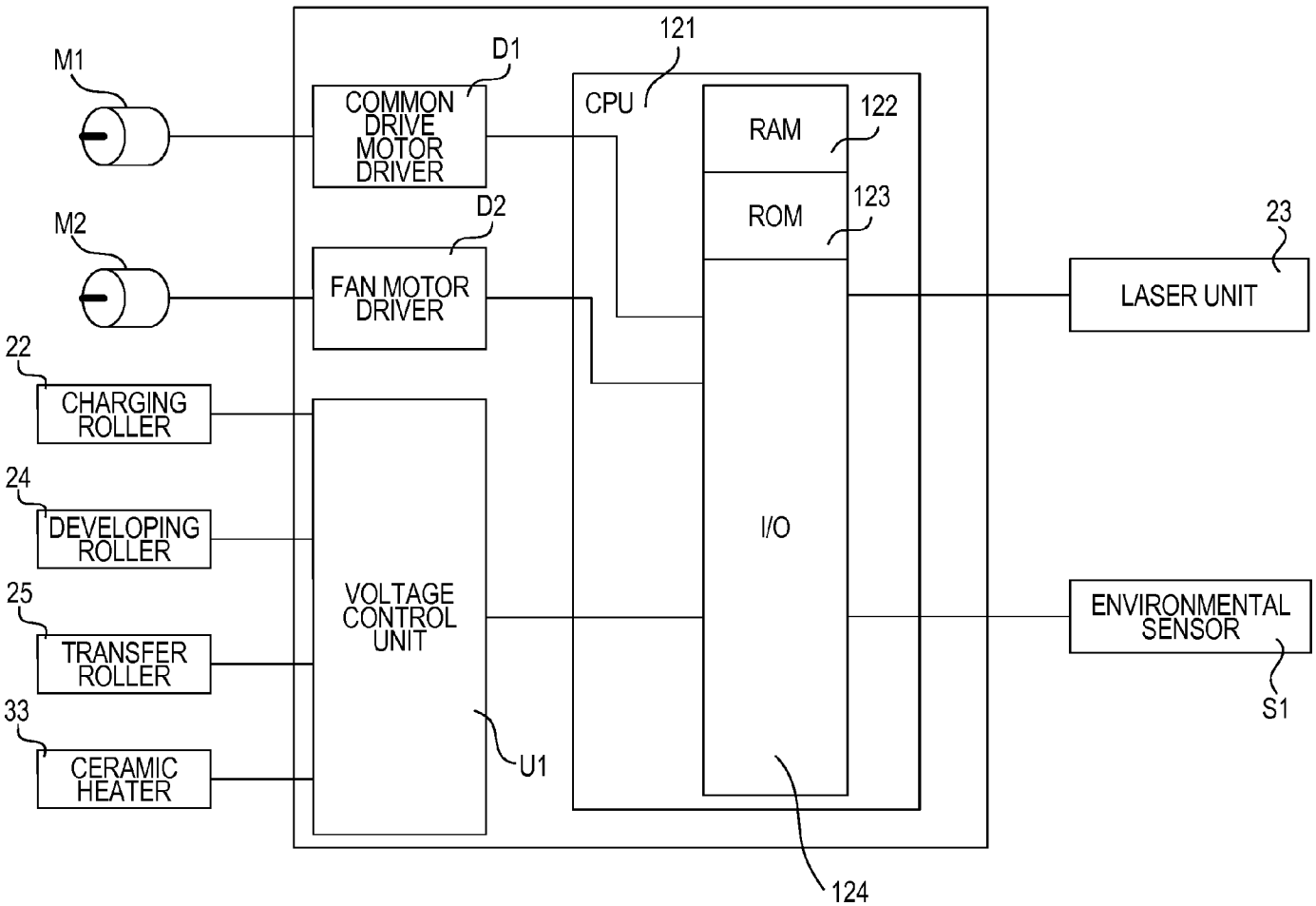
FIG. 3 is a control block diagram of an image forming portion.

FIG. 3 is a block diagram of the image forming apparatus control portion 130 of FIG. 2. In FIG. 3, the image forming apparatus control portion 130 includes, as in the control block diagram of the image forming system of FIG. 2, a CPU 121 serving as a control unit including a RAM 122 used as a storage for input data and a work storage region, and a ROM 123 configured to store programs such as a control sequence.

The CPU 121 is connected, through an I/O port 124, to a voltage control unit U1 configured to apply the voltage to the charging roller 22, the developing roller 24, the transfer roller 25, and the ceramic heater 33 serving as the heat source, the laser unit (exposure unit) 23 configured to expose the surface of the photosensitive drum 21 of FIG. 1 to light, a common drive motor driver D1, and a fan motor driver D2.

The common drive motor driver D1 controls the operation of a common drive motor M1 serving as a drive source configured to rotate the photosensitive drum 21, the developing roller 24, and the transfer roller 25. The fan motor driver D2 controls the operation of a fan motor M2 configured to drive a cooling fan (blower unit) 60 configured to cool the fixing portion 30 and the sheet S of FIG. 1. The cooling fan 60 generates an airflow inside the image forming apparatus 100 in order to cool the fixing portion 30, configured to fix the toner image onto the sheet and the sheet on which the image is formed.

Moreover, the environmental sensor S1 is connected to the CPU 121, and can detect the temperature and the humidity inside the image forming apparatus. The temperature and the humidity inside the image forming apparatus may be detected from a detection result of an environment outside the apparatus instead of directly detecting the environment inside the apparatus. The CPU 121 functions as a determination unit configured to determine a state of at least one of the temperature and the humidity detected by the environmental sensor S1.

Figure 4:
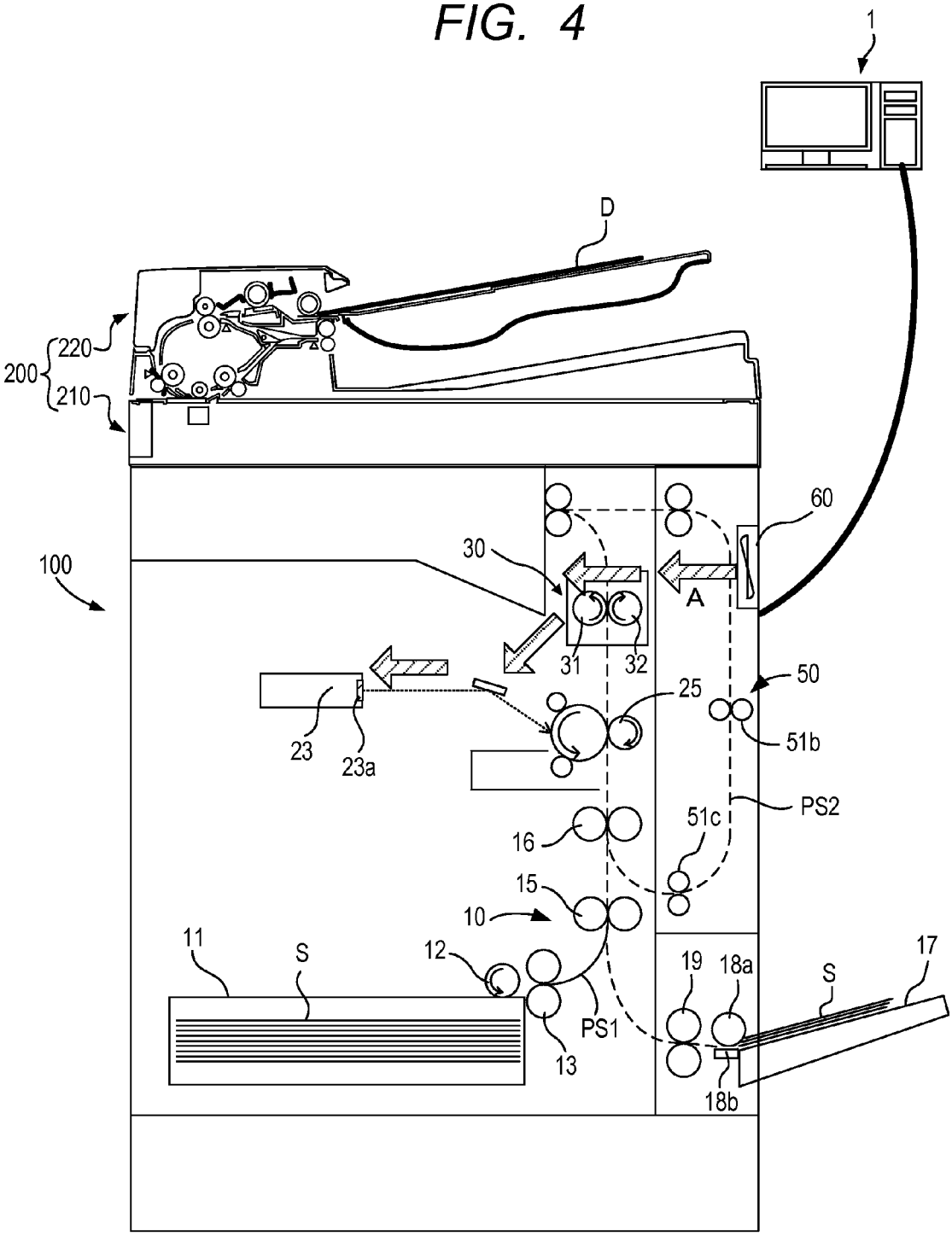
FIG. 4 is an explanatory diagram of a motion of air inside a conventional image forming apparatus.

FIG. 4 is a diagram illustrating the flow of the air inside a conventional image forming apparatus. In FIG. 4, the arrow A represents the flow of the air.

In order to cool the sheet S after being heated and pressurized by the fixing portion 30, the cooling fan 60 blows the outside air to the fixing portion 30 and the sheet S always at a constant airflow volume. When the sheet S is heated by the fixing portion 30, the moisture contained in the sheet S is released as vapor, and the temperature and the humidity of the air around the fixing portion 30 increase.

When the highly humid air reaches the laser scanner 23 serving as the exposure device by the airflow from the cooling fan 60, dew condensation may occur in the laser scanner 23. Particularly when dew condensation occurs on a surface of a dustproof member 23*a* constructed by a transparent member provided on a laser output portion of the laser scanner 23, an image failure, such as a decrease in density of the output image, may occur. This is because, when the dew condensation occurs on the surface of the dustproof member 23*a*, the light intensity of the laser irradiating the photosensitive drum 21 from the laser scanner 23 decreases.

Figure 5:
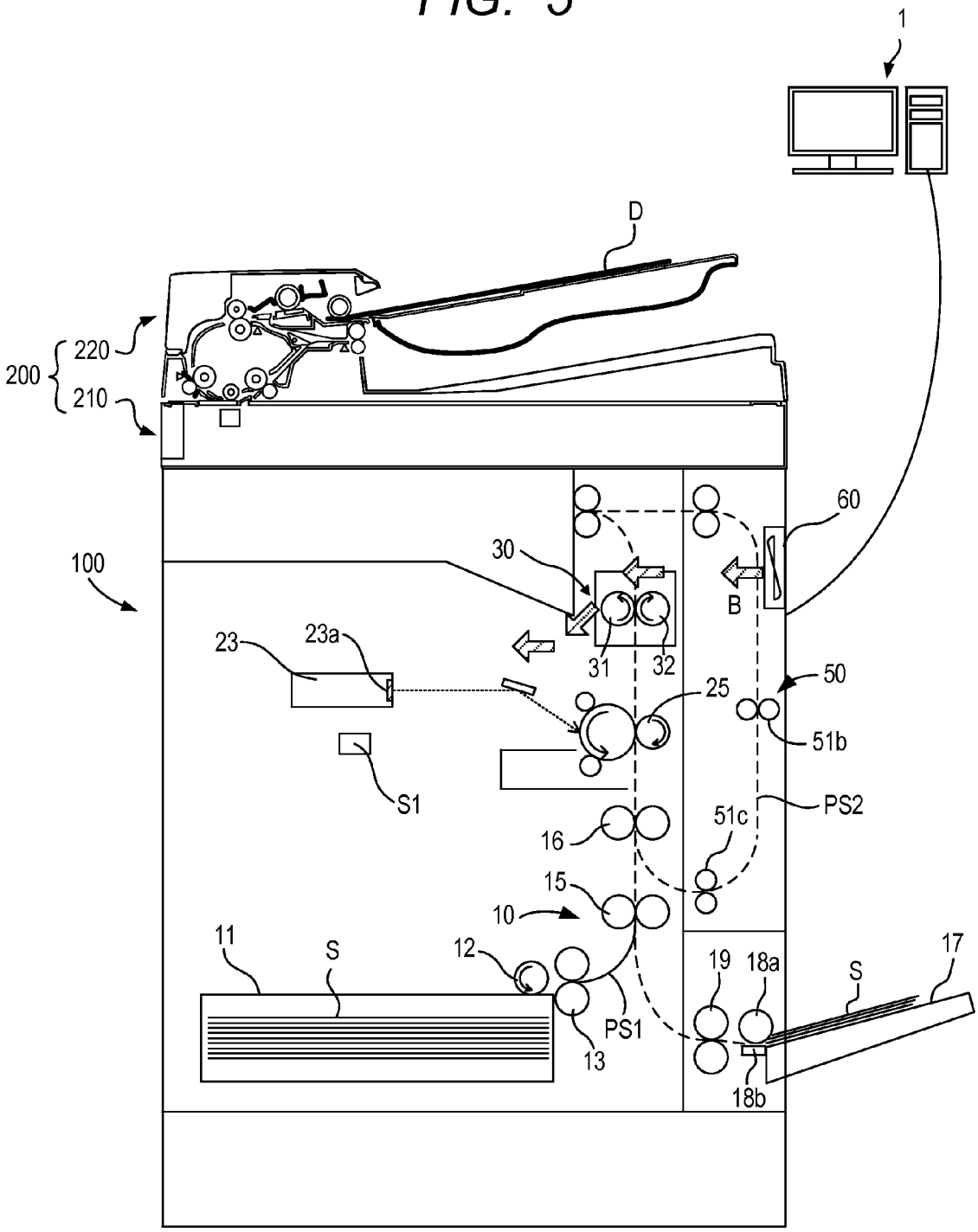
FIG. 5 is an explanatory diagram of the motion of air inside the image forming apparatus according to the present invention.

FIG. 5 is a diagram illustrating the flow of the air inside the image forming apparatus according to the embodiment. The arrow B represents the flow of the air.

The airflow volume from the cooling fan 60 is adjusted by the CPU 121 of FIG. 3, controlling the fan motor M2 via the fan motor driver D1 of FIG. 3. The airflow volume of the cooling fan 60 is adjusted to such a degree that the generated airflow is blocked by the respective components in the image forming apparatus 100 so as not to reach the laser scanner 23. In the embodiment, the airflow volume is adjusted by an output at half speed (50%) with respect to full speed (100%).

Figure 6:
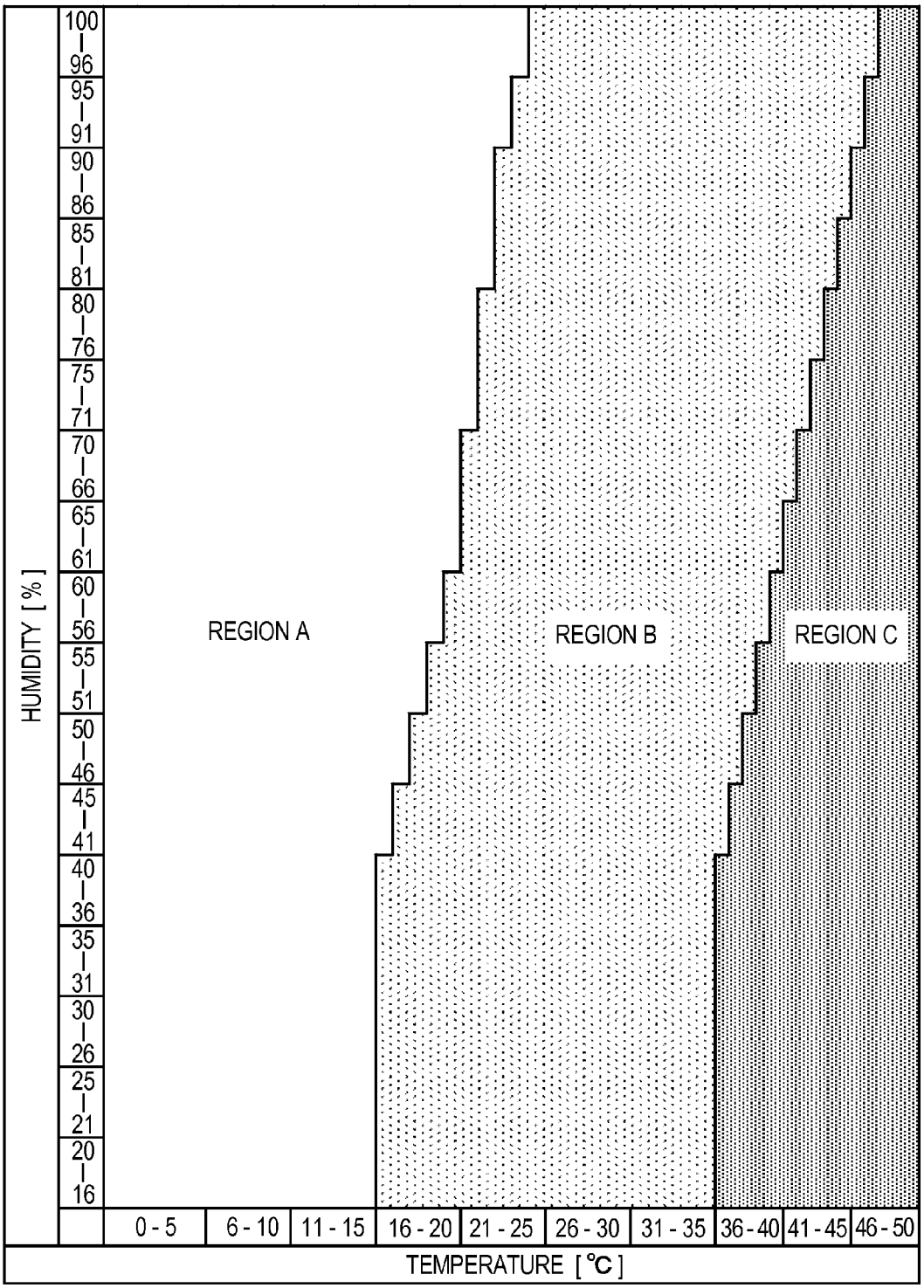
FIG. 6 is a diagram illustrating an example of a table used for control of a fan.

FIG. 6 is a diagram illustrating a table showing drive control of the cooling fan 60 of FIG. 5 with respect to an output result of the environmental sensor S1 of FIG. 5. An environmental condition is divided into three regions: a region A, a region B, and a region C based on the tendency of the occurrence of dew condensation depending on the temperature and the humidity. The CPU 121 of FIG. 3 compares the output of the environmental sensor S1 of FIG. 3 and FIG. 5 with the table of FIG. 6, and then changes the control of the cooling fan 60 of FIG. 5 depending on which of the regions A, B, and C includes the detected environmental condition. In other words, the CPU 121 functions as a control unit configured to reduce the airflow volume of the cooling fan 60 as the degree of the occurrence of the dew condensation increases based on the determination result of a state of at least one of the temperature and the humidity detected by the environmental sensor S1.

As the environmental condition, dew condensation occurs in the apparatus more likely as the temperature decreases and the humidity increases. Therefore, the content of the table is set so as to reduce the airflow volume of the cooling fan 60 in a low temperature region or a high humidity region.

Figure 7:
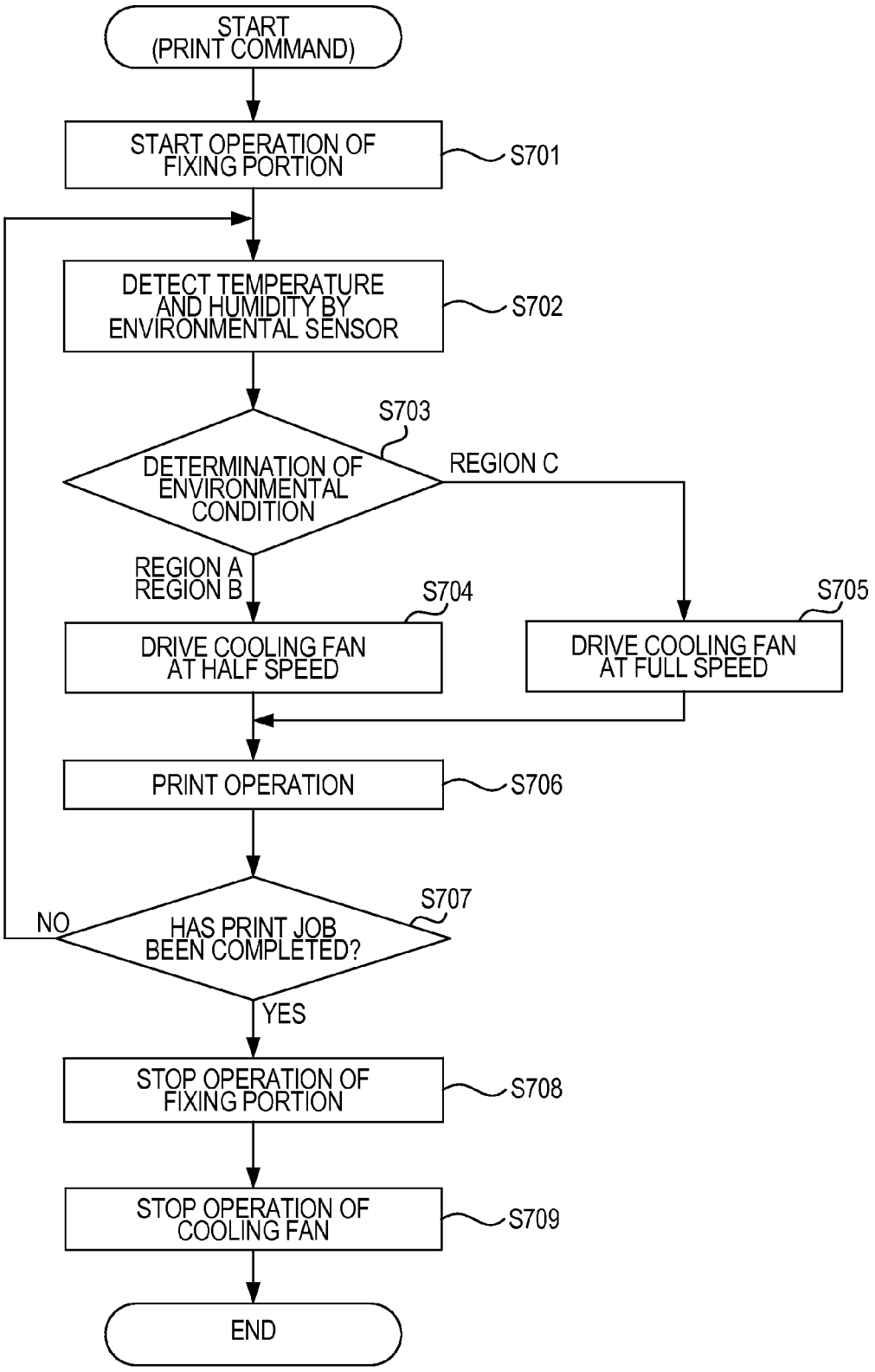
FIG. 7 is a flowchart of control according to a first embodiment.

Referring to a flowchart of FIG. 7, a cooling method according to the embodiment will be described. The processing shown in FIG. 7 is carried out by the CPU 121 of FIG. 3, executing a program stored in the ROM 123 of FIG. 3.

When a print job is transmitted as a print command from the host PC of FIG. 1 to the image forming apparatus 100 of FIG. 1, the CPU 121 of FIG. 3 rotates the common drive motor via the common drive motor driver D1 of FIG. 3, and simultaneously applies a voltage to the ceramic heater of FIG. 3 via the voltage control unit U1 of FIG. 3 to carry out the heating (Step S701).

Then, the CPU 121 uses the environmental sensor S1 of FIG. 3 to detect the temperature and the humidity (Step S702).

Then, the CPU 121 collates the temperature and humidity detected in Step S702 with the table of FIG. 6 (Step S703).

When the environmental condition is in the region A or B, based on a collation result of the temperature and the humidity, the CPU 121 of FIG. 3 controls the fan motor M2 of FIG. 3 via the fan motor driver D2 of FIG. 3, thereby driving the cooling fan 60 of FIG. 5 at the half speed (Step S704).

When the environmental condition is in the region C, the CPU 121 of FIG. 3 drives the cooling fan 60 of FIG. 5 at the full speed (Step S705).

Then, the CPU 121 carries out the print operation of forming an image on the sheet S (Step S706).

When the print job is completed, the CPU 121 stops the operation of the fixing portion 30 (Step S708), stops the operation of the cooling fan 60 (Step S709), and finishes the operation.

When the print job is not completed, the CPU 121 returns to Step S702, and continues the processing.

In order to cool the sheet S, heated and pressurized in the fixing portion 30 of FIG. 5, and cool the fixing portion 30 of FIG. 5, it is desired that the cooling fan 60 of FIG. 5 be always driven at the full speed. However, under an environmental condition that the dew condensation tends to occur, the cooling fan 60 is driven at the half speed, thereby preventing dew condensation from occurring on the laser scanner 23 of FIG. 5. The dew condensation tends to occur under a low temperature condition, and even when the cooling fan 60 is driven at the half speed under a low temperature condition, the airflow volume required for cooling the fixing portion 30 and the sheet S can be maintained.

Note that, according to the embodiment, the operation of the cooling fan 60 is controlled based on the detection results of both the temperature and the humidity, but the operation of the cooling fan 60 can be controlled by using the detection result of only the temperature or the humidity.

Moreover, the environmental condition is divided into three regions: the regions A, B, and C, and the control of the cooling fan 60 has the two stages: the full drive and the half drive, but the control can be carried out while the regions are further finely divided.

Moreover, according to the embodiment, the image forming apparatus using the method of transferring the developer image from the photosensitive drum onto the sheet is described, but the present invention can be applied to an image forming apparatus using a method of transferring the developer image from the photosensitive drum onto an intermediate transfer belt, and further transferring the developer image from the intermediate transfer belt onto the sheet.

As described above, in the image forming apparatus according to the embodiment, based on the environmental condition, under the environmental condition that dew condensation tends to occur, the drive control of the cooling fan 60 is changed so as to reduce the airflow volume. Therefore, the air humidified in the fixing portion 30 does not reach the laser scanner 23. Thus, in the laser scanner serving as the exposure device, dew condensation is prevented from occurring.

Second Embodiment

In a second embodiment, as compared to the image forming apparatus of the first embodiment, a set temperature of the fixing portion 30 is switched depending on the environmental condition inside the image forming apparatus. The second embodiment will be described in detail referring to FIG. 8, but like components that are like the components in the first embodiment are denoted by like reference symbols, and a description thereof is therefore omitted. The fixing portion 30 includes the ceramic heater 33 and the pressurizing roller 32 configured to pressurize the ceramic heater 33 through the endless film. The CPU 121 serves as a temperature setting unit configured to set the temperature of the fixing portion 30 by controlling the voltage control unit U1 configured to apply the voltage to the ceramic heater 33.

For the same set temperature of the ceramic heater 33, regions can be divided as in the environment table of FIG. 6 depending on the tendency of dew condensation, independently of the environmental condition in the image forming apparatus. However, taking into consideration a tendency of the sheet S to curl and a fixing property of the developer to the sheet S, the CPU 121 decreases the set temperature of the ceramic heater 33 as the temperature of the environment inside the image forming apparatus increases, and increases the set temperature of the ceramic heater 33 as the temperature of the environment inside the image forming apparatus decreases. When the set temperature of the ceramic heater 33 increases, the vapor amount generated from the sheet S increases when the sheet S passes through the fixing nip portion N2, and dew condensation tends to occur. Therefore, the cooling fan 60 needs to be controlled in consideration of the influence of the vapor generated from the sheet S, in addition to the temperature and the humidity inside the image forming apparatus.

Figure 8:
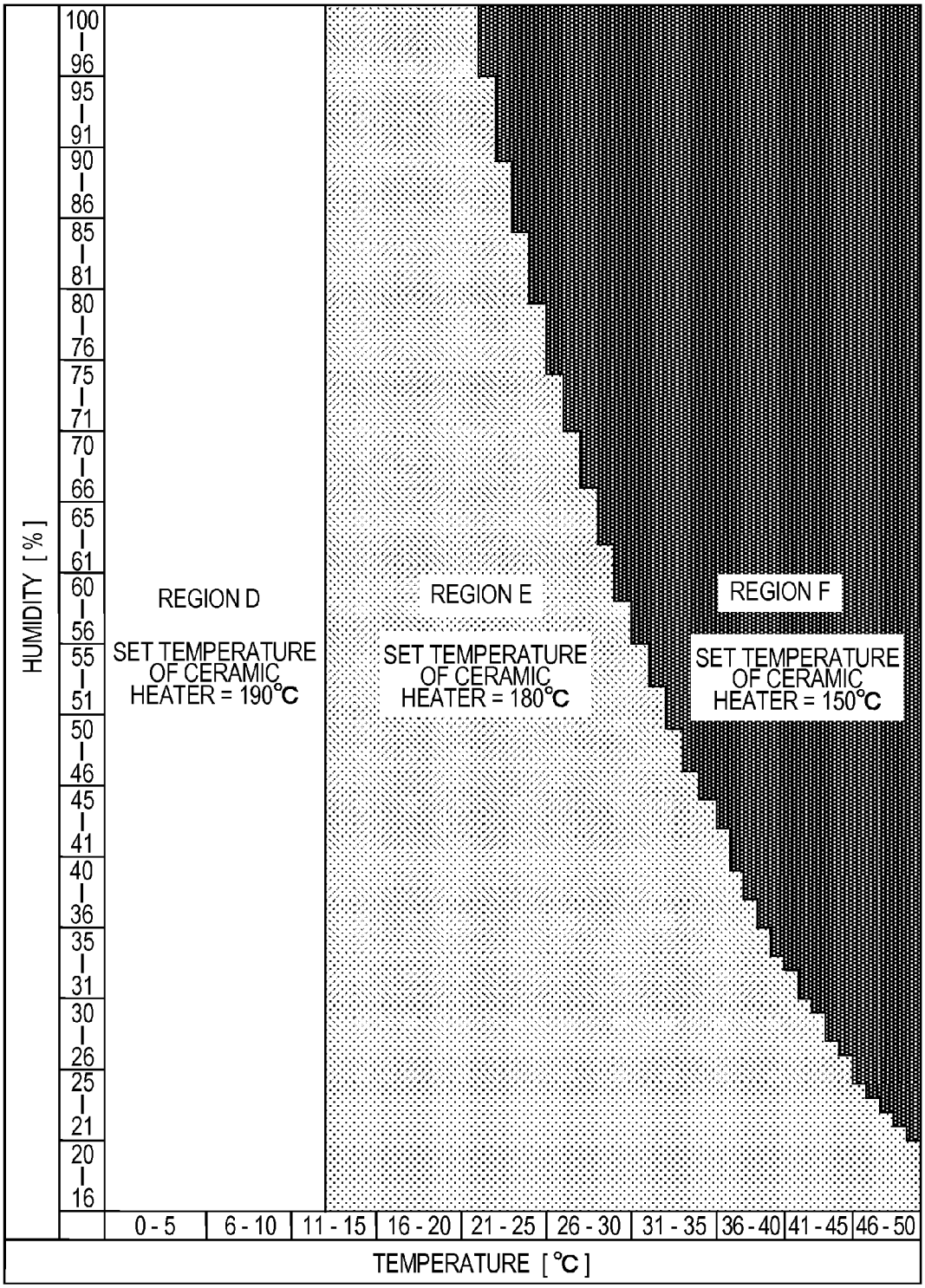
FIG. 8 is a diagram illustrating an example of a table used for the control of the fan taking into consideration a target controlled-temperature for fixing.

FIG. 8 is an example of the environment table used for the control of switching the airflow volume of the cooling fan 60, based on the temperature of the ceramic heater 33 that is set depending on the environmental condition inside the image forming apparatus.

According to the embodiment, the environmental condition is divided into three regions: regions D, E, and F depending on the temperature and the humidity, and the temperature of the ceramic heater 33 is set for each region.

In the region D, the set temperature of the ceramic heater 33 is set to a temperature of 190° C., which is higher than those in the other environmental regions, in order to satisfy the fixing property in the low temperature environment. As a result, the vapor amount generated from the sheet S increases, and dew condensation tends to occur. However, in the region D, the temperature in the image forming apparatus is low, and the sheet S tends to be cooled. Therefore, the environment in the region D is such an environment that less curl occurs, even when the sheet S is not cooled by active blowing, and dew condensation can thus be prevented from occurring by stopping the cooling fan 60.

The region E corresponds to an intermediate environment between the regions D and F, and the set temperature of the ceramic heater 33 is 180° C. In the region E, the temperature of the sheet S and the vapor amount generated from the sheet S are intermediate values between those in the regions D and F. In the region E, the cooling fan 60 is driven at half speed (50%), thereby preventing dew condensation from occurring while curling is prevented from occurring by cooling the sheet by the blowing.

In this way, the CPU 121 changes the drive condition of the cooling fan 60 so as to reduce the airflow volume as the set temperature of the ceramic heater 33 increases.

The region F corresponds to an environment in which the temperature and the humidity in the image forming apparatus are high, and the set temperature of the ceramic heater 33 is 150° C. The region F corresponds to an environmental condition in which the temperature in the image forming apparatus is high and dew condensation less occurs. The set temperature of the ceramic heater 33 is lower, and the vapor amount generated from the sheet S is thus smaller. Therefore, even when the cooling fan 60 is rotated at the full speed, dew condensation can be prevented from occurring.

Referring to a flowchart of FIG. 9, the cooling method according to the embodiment will be described. Note that, portions redundant with the flowchart of FIG. 7 will not be described.

Figure 9:
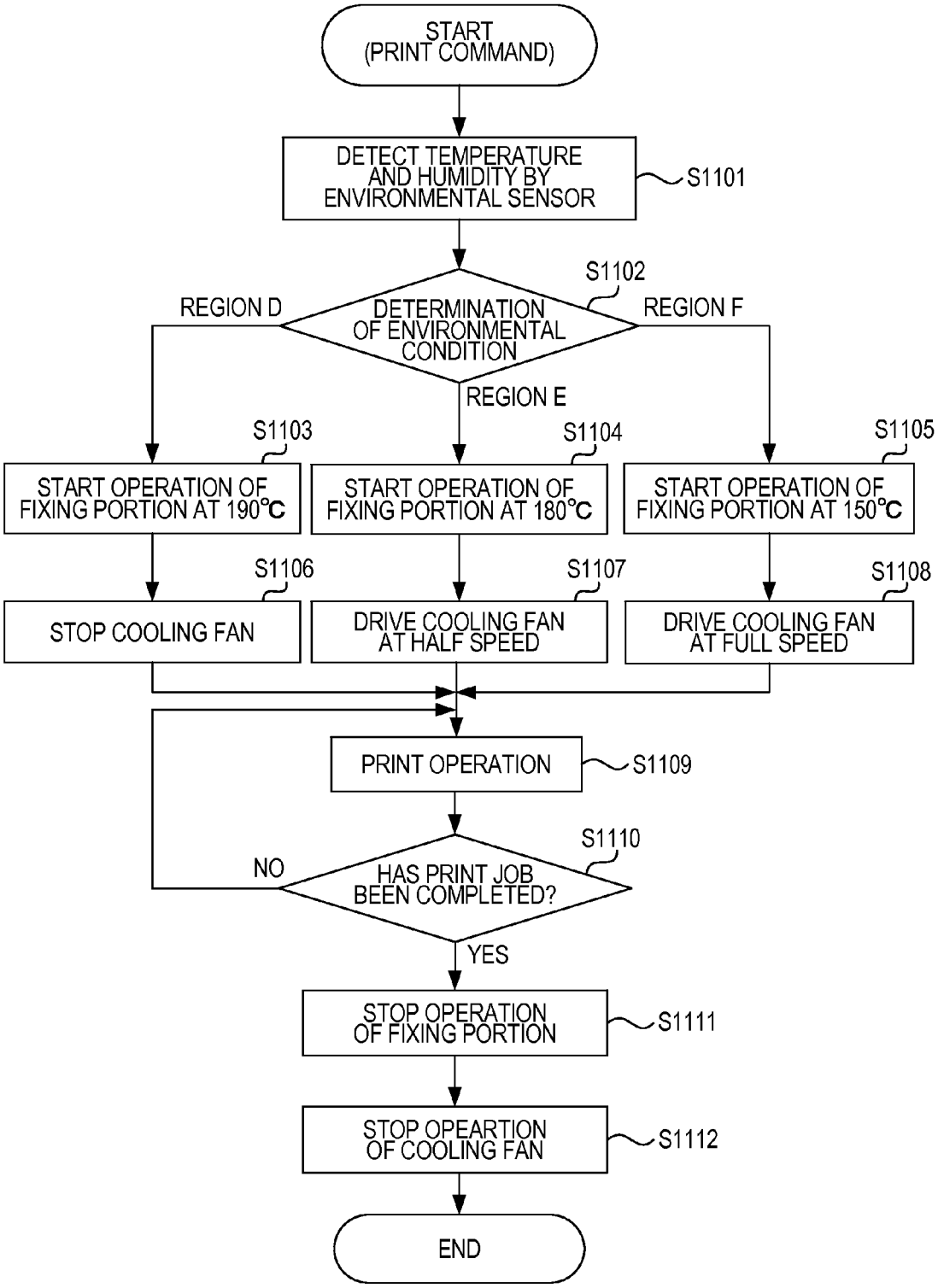
FIG. 9 is a flowchart of control according to a second embodiment.

Processing of FIG. 9 is carried out by the CPU 121 of FIG. 3 executing a program stored in the ROM 123 of FIG. 3.

When a print job is transmitted as a print command from the host PC of FIG. 1 to the image forming apparatus 100 of FIG. 1, the CPU 121 of FIG. 3 uses the environmental sensor S1 of FIG. 3 to detect the temperature and the humidity (Step S1101).

Then, the CPU 121 collates the temperature and humidity detected in Step S1101 with the table of FIG. 8 (Step S1102).

When the environmental condition is determined to be in the region E based on the collation result of the temperature and the humidity, the CPU 121 of FIG. 3 rotates the common drive motor via the common drive motor driver D1 of FIG. 3, and controls the ceramic heater 33 of FIG. 3 via the voltage control unit U1 of FIG. 3 to carry out the heating depending on the environmental condition of the temperature and humidity detected in Step S1101. The CPU 121 sets an attainment target temperature to 190° C. when the environmental condition is in the region D (Step S1103), 180° C. when the environmental condition is in the region E (Step S1104), or 150° C. when the environmental condition is in the region F (Step S1105), and carries out the heating operation to attain the set temperature.

Then, the CPU 121 controls the fan motor M2 of FIG. 3 via the fan motor driver D2 of FIG. 3, thereby driving the cooling fan 60 of FIG. 5.

The CPU 121 stops the drive of the cooling fan 60 when the environmental condition is in the region D (Step S1106), drives the cooling fan 60 at the half speed when the environmental condition is in the region E (Step S1107), and drives the cooling fan 60 at the full speed when the environmental condition is in the region F (Step S1108).

Then, the CPU 121 carries out the print operation for forming an image on the sheet S (Step S1109).

When the print job is completed, the CPU 121 stops the operation of the fixing portion 30 (Step S1111), stops the operation of the cooling fan 60 (Step S1112), and finishes the operation.

When the print job is not completed, the CPU 121 returns to Step S1109, and continues the processing.

Note that, according to the embodiment, the operation of the cooling fan 60 is controlled based on the detection results of both the temperature and the humidity, but the cooling fan 60 can be controlled by using the detection result of only the temperature or the humidity.

Moreover, the environmental condition is divided into three regions: the regions D, E, and F, and the control of the cooling fan 60 has the three stages: full drive, half drive, and the stop, but the control can be carried out while the regions are further finely divided.

As described above, in the image forming apparatus according to the embodiment, based on the environmental condition and the temperature of the ceramic heater 33 set based on the environmental condition, under the environmental condition that dew condensation tends to occur, the drive control of the cooling fan 60 is changed so as to reduce the airflow volume. Therefore, the air humidified in the fixing portion 30 does not reach the laser scanner 23. Thus, dew condensation can be prevented from occurring in the laser scanner serving as the exposure device.

Third Embodiment

In a third embodiment, as compared to the image forming apparatus according to the first embodiment, the cooling method is changed depending on the number of sheets to be printed.

Figure 10:
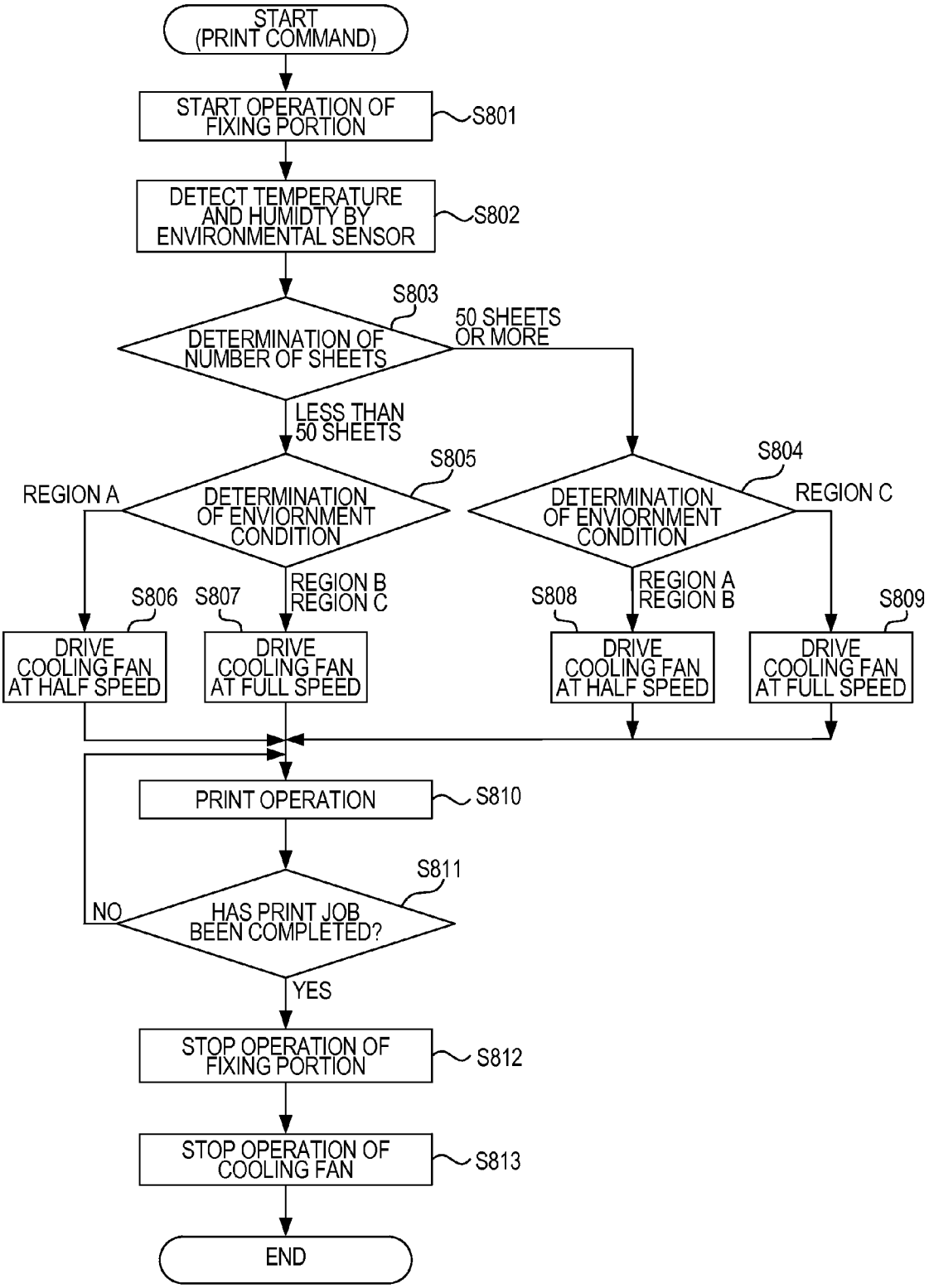
FIG. 10 is a flowchart of control according to a third embodiment.

Referring to a flowchart of FIG. 10, the cooling method according to the embodiment will be described. Note that, portions redundant with the flowchart of FIG. 7 will not be described. Further, like components like the components of the first embodiment are denoted by like reference symbols as of the first embodiment, and a description thereof is therefore omitted. According to the third embodiment, the CPU 121 functions as a number-of-sheets-to-be-printed detection unit configured to detect the number of sheets to be printed in the print job.

After the image forming apparatus 100 of FIG. 1 receives the print command from the host PC of FIG. 1, the CPU 121 of FIG. 3 starts the operation of the fixing portion 30 of FIG. 1 (Step S801), and uses the environmental sensor S1 of FIG. 3 to detect the temperature and the humidity (Step S802).

Then, the CPU 121 of FIG. 3 determines the number of sheets to be printed of the print job transmitted from the host PC of FIG. 1 (Step S803).

When the number of sheets to be printed is less than 50, the CPU 121 proceeds to Step S805, and carries out the environmental determination. When the environmental condition is in the region A of the table of FIG. 6, the CPU 121 drives the cooling fan 60 of FIG. 1 at half speed (Step S806). When the environmental condition is in the region B or C, the CPU 121 drives the cooling fan 60 of FIG. 1 at full speed (Step S807).

When the number of sheets to be printed is 50 or more, the CPU 121 proceeds to Step S804, and carries out the environmental determination. When the environmental condition is in the region A or B of the table of FIG. 6, the CPU 121 drives the cooling fan 60 of FIG. 1 at half speed (Step S808). When the environmental condition is in the region C, the CPU 121 drives the cooling fan 60 of FIG. 1 at full speed (Step S809).

Then, the CPU 121 carries out the print operation for forming an image on the sheet S (Step S810). When the print job is completed, the CPU 121 stops the operation of the fixing portion 30 (Step S812), stops the operation of the cooling fan 60 (Step S813), and finishes the operation.

When the print job is not completed, the CPU 121 returns to Step S810, and continues the processing.

In this way, according to the third embodiment, when the environmental condition is in the region B, the CPU 121 changes the drive condition of the cooling fan 60 so as to reduce the airflow volume as the number of sheets to be printed in the print job increases.

As a result of the above-mentioned control, even when the number of sheets of the print job is large and the humidity thus tends to increase in the apparatus, dew condensation can be prevented from occurring in the laser scanner serving as the exposure device.

Note that, in the embodiment, the configuration of changing the cooling method depending on the number of sheets to be printed in the image forming apparatus according to the first embodiment is described, but a similar combination can also be realized for the image forming apparatus according to the second embodiment.

Fourth Embodiment

In a fourth embodiment, as compared to the image forming apparatus according to the first embodiment, the cooling method is changed depending on the size of the sheet on which the image is to be formed.

Figure 11:
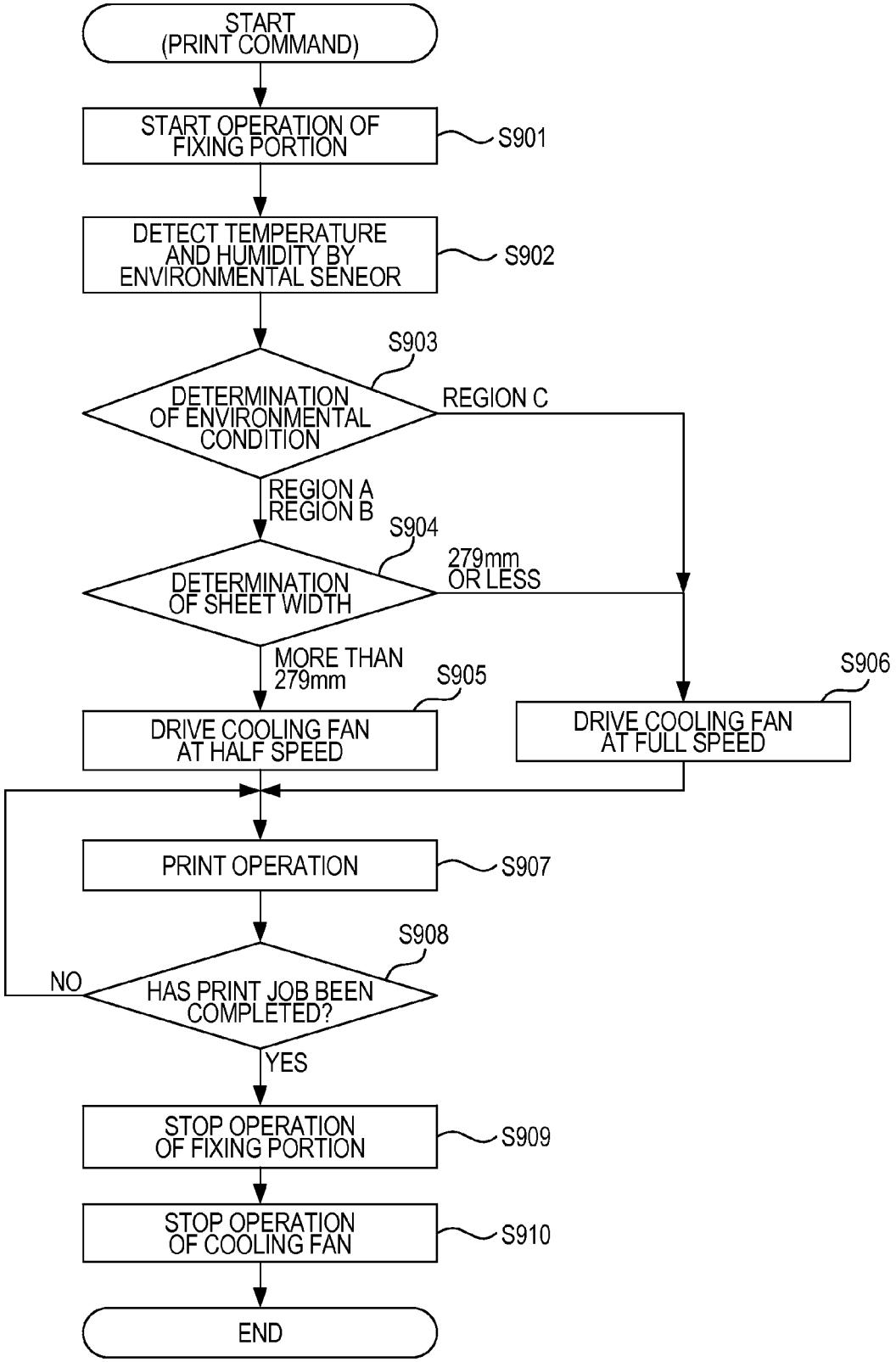
FIG. 11 is a flowchart of control according to a fourth embodiment.

Referring to a flowchart of FIG. 11, the cooling method according to the embodiment will be described. Note that, portions redundant with the flowchart of FIG. 7 and FIG. 10 will not be described. Further, like components like the components in the first embodiment are denoted by like reference symbols, and a description thereof is therefore omitted. According to the fourth embodiment, the CPU 121 functions as a sheet size detection unit configured to detect the size of the sheet on which the image is to be formed.

After the image forming apparatus 100 of FIG. 1 receives a print job as a print command from the host PC of FIG. 1, the CPU 121 of FIG. 3 starts the operation of the fixing portion 30 of FIG. 1 (Step S901), and uses the environmental sensor S1 of FIG. 3 to detect the temperature and the humidity (Step S902).

Then, the CPU 121 proceeds to Step S903, and determines the environmental condition. When the environmental condition is in the region A or B of the table of FIG. 6, the CPU 121 carries out the sheet width determination in Step S904.

The CPU 121 of FIG. 3 determines the width of the sheet S on which the image is to be formed based on the content of the print job transmitted from the host PC of FIG. 1. When the width of the sheet S is more than 279 mm of the letter size, the CPU 121 of FIG. 3 drives the cooling fan 60 of FIG. 1 at half speed (Step S905).

When, in Step S903, the environmental condition is determined to be in the region C, and when, in Step S904, the width of the sheet S is determined to be 279 mm of the letter size or less, the CPU 121 of FIG. 3 proceeds to Step S906, and drives the cooling fan 60 of FIG. 1 at full speed.

When the width of the sheet S in the sheet passage direction is smaller than a sheet passage region, in the fixing portion 30 of FIG. 1, the area of the contact of the sheet S with the fixing nip portion N2 decreases, and the vapor generated by the heating of the sheet S is thus decreased. Therefore, even when the cooling fan 60 is driven at full speed, dew condensation in the laser scanner 23 does not occur.

In this way, according to the fourth embodiment, when the environmental condition is in the region A or B, the CPU 121 changes the drive condition of the cooling fan so as to reduce the airflow volume as the sheet size increases.

As a result of the above-mentioned control, independently of the size of the sheet on which the image is to be formed, the dew condensation can be prevented from occurring in the laser scanner serving as the exposure device.

Note that, in this embodiment, the configuration of changing the cooling method depending on the size of the sheet on which the image is to be formed in the image forming apparatus according to the first embodiment is described, but a combination with another embodiment can also be realized.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

In the above embodiments, the image forming apparatus in which a toner image is directly transferred from the photosensitive drum to a recording medium is described. However, it need scarcely be said that the invention can be applied to an image forming apparatus in which a toner image is transferred from the photosensitive drum through an intermediate transfer member to a recording medium.

This application claims the benefit of Japanese Patent Application Nos. 2014-201075, filed Sep. 30, 2014 and 2015-144069, filed Jul. 21, 2015 which are hereby incorporated by reference herein in their entirety.

What is claimed is:

1. An image forming apparatus, comprising:

an exposure unit configured to expose an image bearing member according to image data to form an electrostatic latent image;

a developing unit configured to develop the electrostatic latent image formed on the image bearing member by the exposure unit into a toner image;

a transfer unit configured to transfer the toner image developed by the developing unit onto a recording medium;

a fixing unit configured to fix the toner image, which is transferred onto the recording medium by the transfer unit, to the recording medium by heat;

a blower unit configured to blow air past or around the fixing unit to reach the exposure unit; and a control unit configured to reduce the air reaching the exposure unit based on a degree of increase in the occurrence of dew condensation.

2. An image forming apparatus according to claim 1, wherein the control unit determines the degree of the increase in the occurrence of dew condensation based on a state of at least one of temperature and humidity.

3. An image forming apparatus according to claim 1, further comprising a temperature setting unit configured to set a temperature of the fixing unit, wherein the control unit is configured to change a drive condition for the blower unit to reduce the air reaching the exposure unit as the temperature set by the temperature setting unit increases.

4. An image forming apparatus according to claim 1, further comprising a number-of-sheets-to-be-printed detection unit configured to detect a number of sheets to be printed in a print job, wherein the control unit is configured to change a drive condition for the blower unit to reduce the air reaching the exposure unit as the number of sheets to be printed increases.

5. An image forming apparatus according to claim 1, further comprising a sheet size detection unit configured to detect a size of a sheet on which an image is to be formed, wherein the control unit is configured to change a drive condition for the blower unit to reduce the air reaching the exposure unit as the size of the sheet increases.

6. An image forming apparatus, comprising:

an exposure unit configured to expose an image bearing member according to image data to form an electrostatic latent image;

a developing unit configured to develop the electrostatic latent image formed on the image bearing member by the exposure unit into a toner image;

a transfer unit configured to transfer the toner image developed by the developing unit onto a recording medium;

a fixing unit configured to fix the toner image, which is transferred onto the recording medium by the transfer unit, to the recording medium by heat;

a blower unit configured to blow air past or around the fixing unit to reach the exposure unit; and a control unit configured to reduce the air reaching the exposure unit based on an increase in humidity.

* * * * *